United States Patent [19]

Miller

[11] Patent Number: 4,574,492

[45] Date of Patent: Mar. 11, 1986

[54] COMBINATION LAYOUT TOOL AND SQUARE

[76] Inventor: Tony Miller, 3266 Bozeman St., Sacramento, Calif. 95838

[21] Appl. No.: 466,571

[22] Filed: Feb. 15, 1983

[51] Int. Cl.[4] ..... B43L 7/00

[52] U.S. Cl. ..... 33/427; 33/464; 33/429; 33/481; 33/476

[58] Field of Search ..... 33/427, 464, 473, 479, 33/480, 481, 474, 429, 476, 477, 415–417, 174 B, 174 G, 403, 26

[56] References Cited

U.S. PATENT DOCUMENTS

| | | | |
|---|---|---|---|
| 387,966 | 8/1888 | Beckwith | 33/429 |
| 778,521 | 12/1904 | Wheat | 33/42 |
| 1,135,259 | 4/1915 | Cokely | 33/481 |
| 1,257,683 | 2/1918 | Defenbaugh | 33/480 |
| 1,560,417 | 11/1925 | Dreschler | 33/2 H |
| 1,732,906 | 10/1929 | Morton | 33/42 |
| 2,594,193 | 4/1952 | Mendes | 33/26 |
| 2,646,626 | 7/1953 | Palin | 33/427 |
| 3,169,320 | 2/1965 | Currie | 33/429 |
| 3,439,426 | 4/1969 | Wilson | 33/32 B |
| 3,456,353 | 7/1969 | Iams | 33/474 X |
| 4,361,964 | 12/1982 | Hennessee | 33/481 X |
| 4,380,124 | 4/1983 | Smith | 33/433 |

*Primary Examiner*—Harry N. Haroian
*Attorney, Agent, or Firm*—Paul L. Hickman

[57] ABSTRACT

A combination device including a layout tool having a rectangular plate and a rectangular endpiece; and a square adaptor having an attachment plate and a ruler assembly. The layout tool is provided with a number of slots and apertures which allow a construction worker to make quick, standard measurements. The square adaptor includes a pivotable ruler which can be aligned parallel to or perpendicular to the longitudinal edges of the layout tool.

19 Claims, 23 Drawing Figures

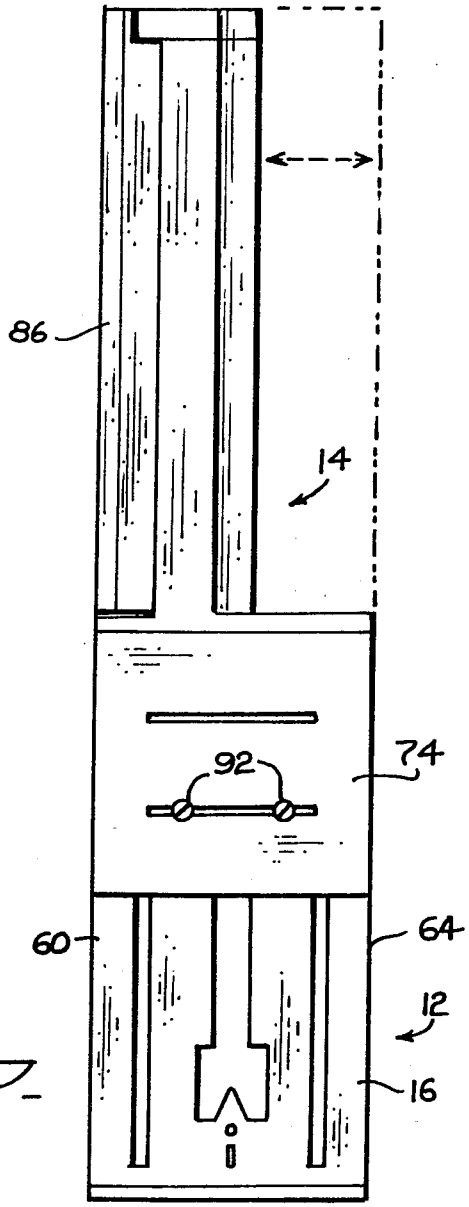
FIG. 7
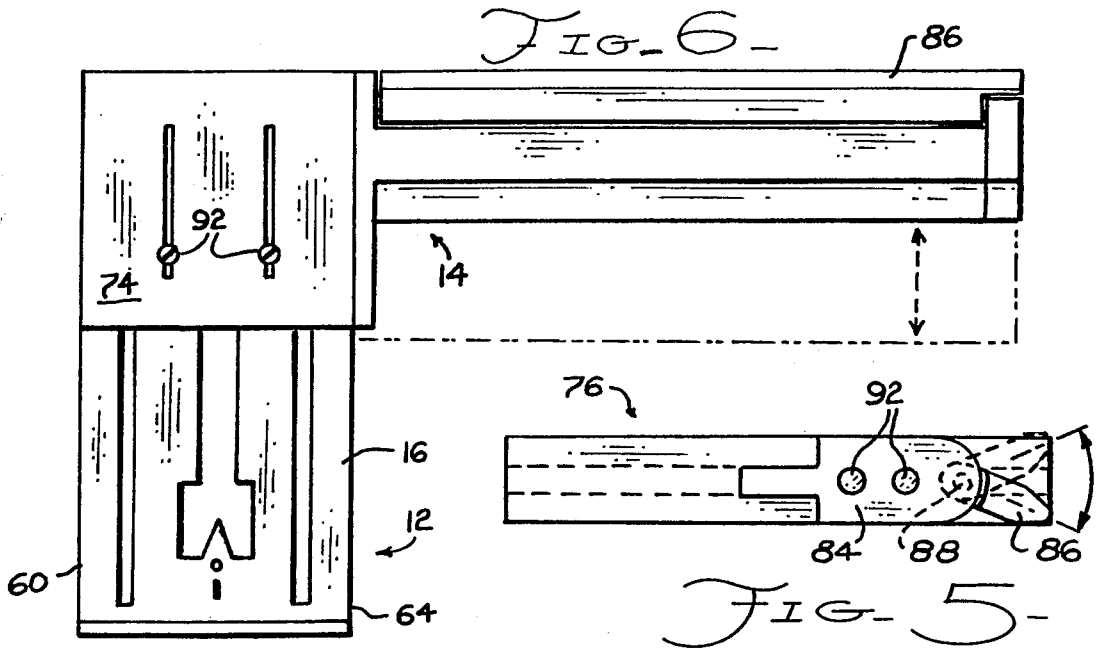
FIG. 6
FIG. 5
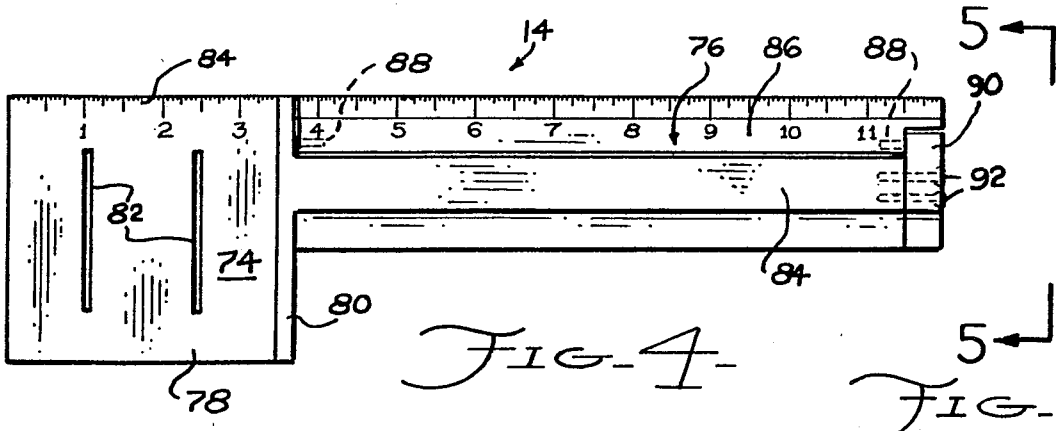
FIG. 4

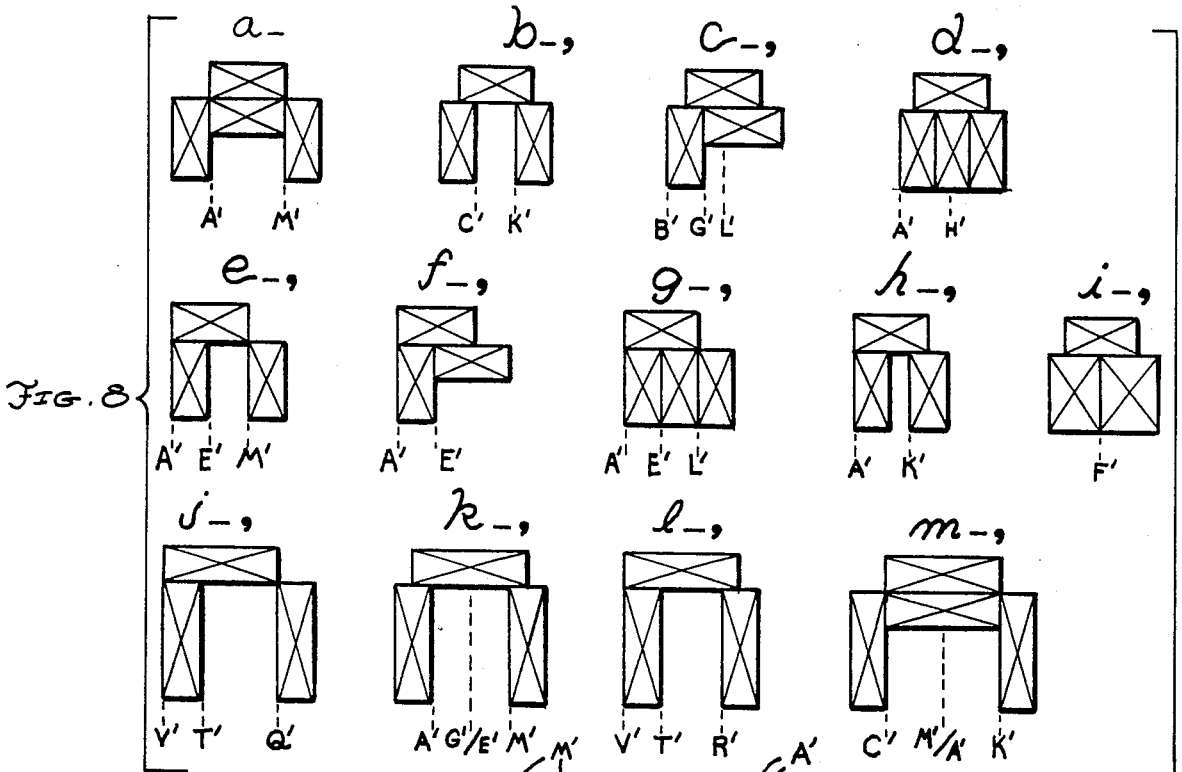
FIG. 8
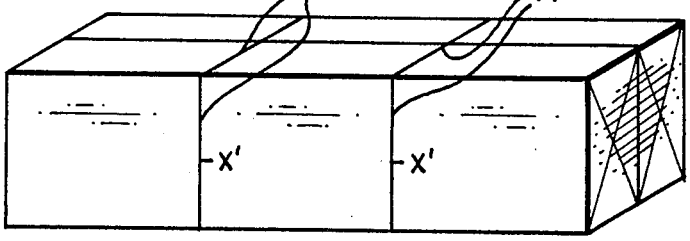
FIG-8-m-
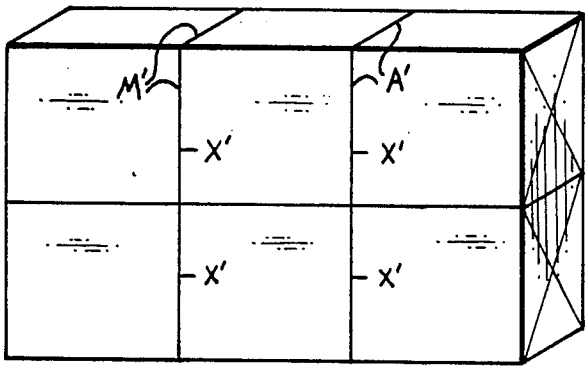
FIG-8-p-
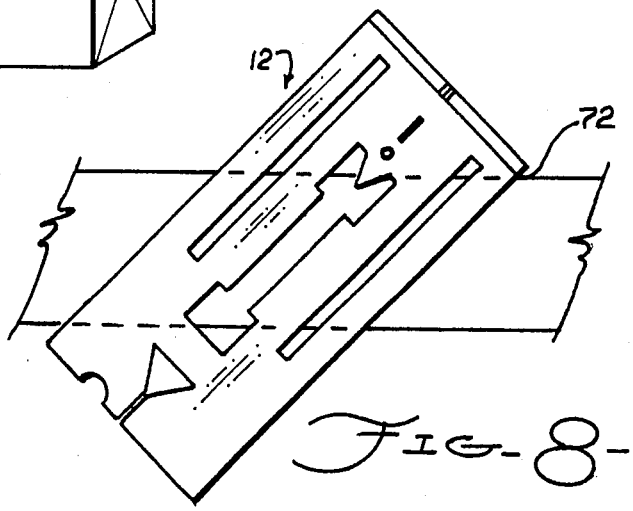
FIG-8-q-

COMBINATION LAYOUT TOOL AND SQUARE

BACKGROUND OF THE INVENTION

1. Field of the Invention

This invention relates generally to hand tools and more particularly to measuring and layout tools.

2. Description of the Prior Art

The prior art discloses a number of measurement tools designed for specific applications. For example, in U.S. Pat. No. 1,125,010 Doner teaches a rafter tool including a main body portion and a leg portion angling away from the main body portion. The main body portion is slotted to provide for quick, standard measurements. Similar rafter tools are disclosed in U.S. Pat. Nos. 2,965,969 of Haley, 3,010,209 of McKinley, and 2,204,927 of Cramer.

Framing squares are also described in a number of patents. For example, in U.S. Pat. No. 223,709 of Cornell a framing square including a ruler portion and an arm portion extending perpendicularly from an end of the ruler portion is taught. The ruler portion is provided with a number of slots. A similar tool is disclosed in U.S. Pat. No. 2,575,595 of Rienecker.

In German Pat. No. 2,906,921 of Wolff a layout tool is disclosed including a triangularly shaped member provided with a pair of slots, and an endpiece attached to one edge of the triangularly shaped member for engaging an edge of a work piece. The endpiece extends both above and below the surface of the triangularly shaped member such that the tool has a T shaped cross section. The tool is primarily used for marking lines along a plank in preparation for a rip cut.

What the prior art does not disclose is a construction layout tool of more general capabilities. That is to say, the prior art does not teach a tool which is adapted for measuring rafters, wall partitions, and which can also be used as a square. Thus, a construction worker must own and carry a number of separate tools for those tasks.

SUMMARY OF THE INVENTION

An object of this invention is to provide a construction layout tool which can perform virtually any measurements necessary for construction.

Briefly, the invention includes a layout tool and a square adaptor. The layout tool includes an elongated, rectangular plate having a rectangular endpiece along a first transverse edge. The endpiece is substantially normal to the rectangular plate and has an upwardly extending portion and a downwardly extending portion. The square adaptor includes an attachment plate adapted to engage an upper surface of the rectangular plate of the layout tool, and a ruler assembly extending away from an edge of the attachment plate.

The upwardly extending portion of the layout tool's endpiece is twice the height of the lower extension of the endpiece. Preferably, the lower extension is exactly the thickness of a standard 2×4. The width of the plate and the endpiece of the layout tool is preferably exactly the transverse width of a standard 2×4. The rectangular plate is provided with center line markings, and an elongated, central slot aligned with the center line markings. The plate is also provided with a pair of slots on either side of the central slot, and a triangular opening having an apex aligned with the center line marks. The endpiece is also provided with an "M" shaped aperture and a pair of slots. Each of the apertures and slots on the device have a specific purpose.

The square adaptor of the device includes an attachment plate, and a ruler assembly extending from one end of the attachment plate. The attachment plate is provided with a pair of slots through which fasteners can attach the attachment plate to an upper surface of the rectangular plate of layout tool. The square adaptor can be attached to the layout tool such that the ruler assembly is at substantially right angles to the longitudinal edges of the layout tool or it can be attached so that the ruler assembly is parallel to the longitudinal edges of the layout tool.

An advantage of this invention is that a single tool can be used to replace a number of measuring tools.

These and other objects and advantages of the present invention will no doubt become apparent upon a reading of the following descriptions and a study of the several figures of the drawing.

BRIEF DESCRIPTION OF THE DRAWING

FIG. 4 is a top plan view of the square adaptor shown in FIG. 1.

FIG. 5 is a end view taken along line 5—5 of FIG. 4.

FIG. 6 is a top plan view of the combination layout tool and square shown in FIG. 1.

FIG. 7 is a top plan view of the combination tool with the square adaptor in an alternate position.

FIGS. 8A–8Q show some of the ways that the layout tool and square can be used for construction purposes.

DETAILED DESCRIPTION OF THE PREFERRED EMBODIMENT(S)

Figure 1:
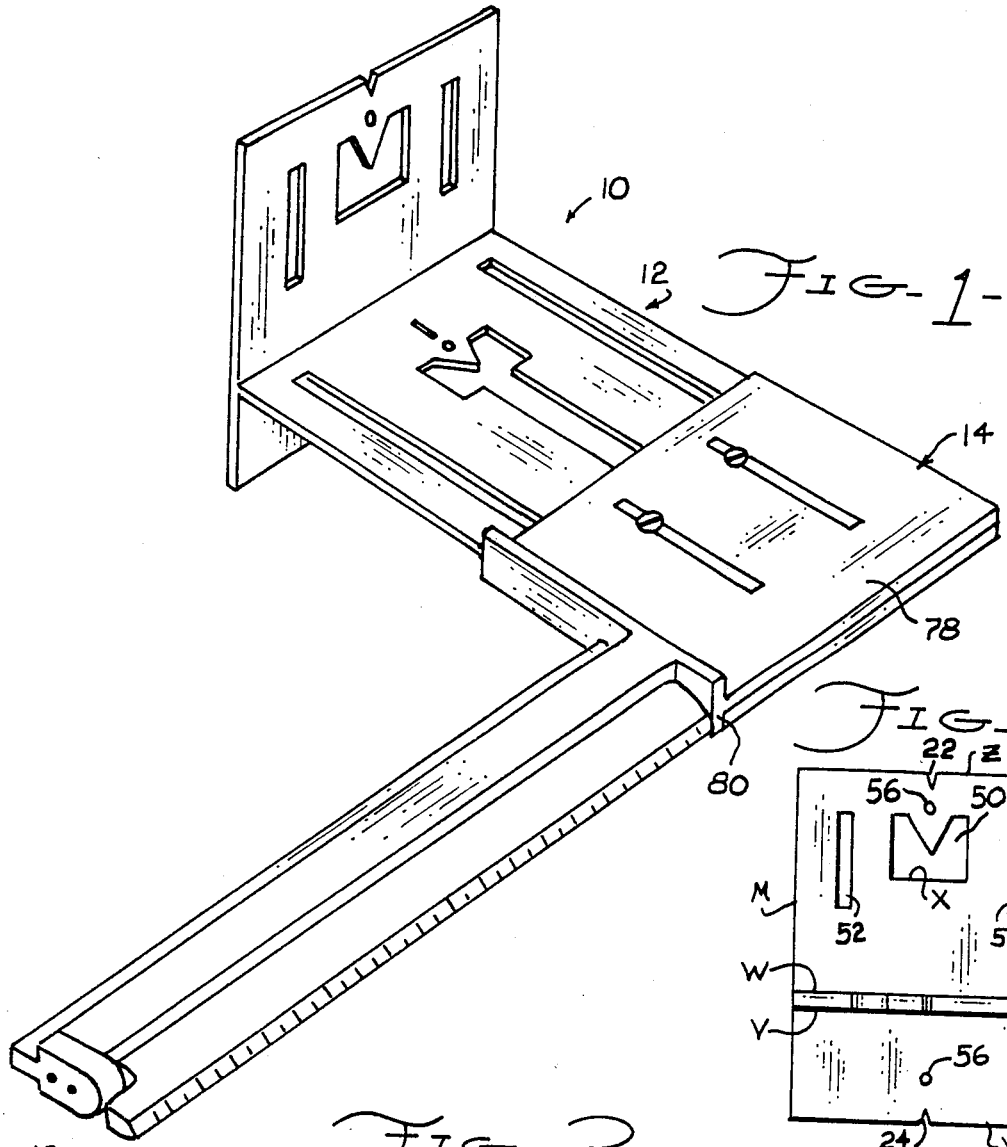
FIG. 1 is a perspective view of a combination layout tool and square in accordance with the present invention.
Figure 3:
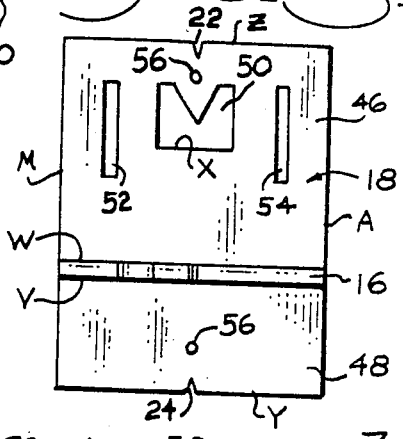
FIG. 3 is an end elevational view taken along line 3—3 of FIG. 2.
Figure 2:
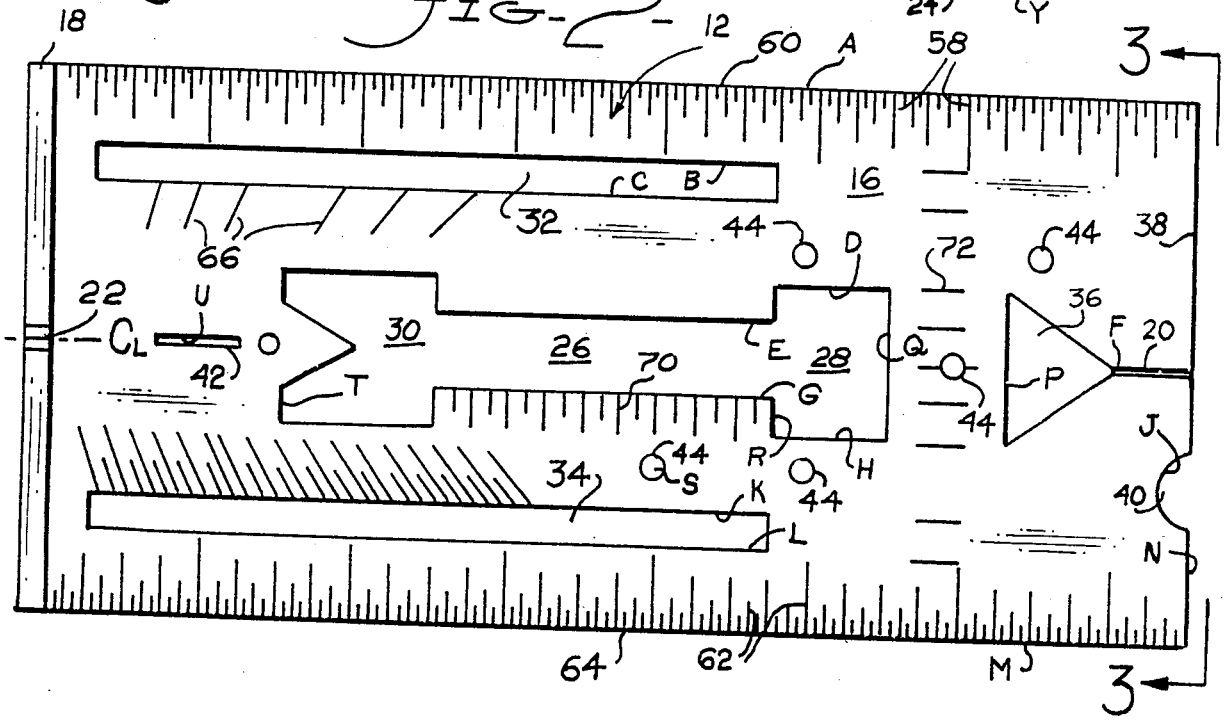
FIG. 2 is a top plan view of the layout tool shown in FIG. 1.

Referring to FIG. 1, a combination layout tool and square 10 includes a layout tool 12 and a square adaptor 14. Referring additionally to FIGS. 2 and 3, layout tool 12 includes an elongated, rectangular plate 16, and a rectangular endpiece 18. Layout tool portion 12 has a center line $C_L$ and center line markings at 20, 22, and 24.

Rectangular plate 16 is provided with an elongated, central slot 26 aligned with the center line markings 20, 22, and 24. Central slot 26 has a head portion 28 which is widened into a square, and a tail portion 30 which is widened into a notched square. On either side of central slot 26, plate 16 is provided with a slot 32 and 34. A triangular aperture 36 having its apex aligned with the center line is provided near a front edge 38 of plate 16, and a semi-circular notch 40 is provided nearby. A measuring tape slot 42 is provided near tail portion 30 of the central slot, and a number of holes 44 are provided through the top of plate 16.

Referring to FIG. 3, endpiece 18 includes an upper portion 46 extending upwardly from plate 16, and a lower portion 48 extending downwardly from plate 16. The upper portion 46 is provided with a notched square aperture 50 and a pair of side slots 52 and 54. Both upper portions 46 and lower portions 48 are provided with a hole 56 near center line markings 22 and 24, respectively. Referring again to FIG. 2, plate 16 has ruler markings 58 proximate a first longitudinal edge 60, and a second set of ruled markings 62 proximate a second longitudinal edge 64. Rule markings 58 and 62 are preferably in ⅛ inch increments, as this is the maximum level of tolerance normally used for construction. Plate 16 is also provided with markings at 66 which are used for angled cuts, and markings at 68 which are used for cuttings rafters. The markings at 70 are used as a stair guage, and the markings at 72 are used for measuring studs. The markings on the other side of plate 16 are similar to the ones in the top plan view, except that the markings opposite those shown at 66 are designed for hip and valley rafters, and the markings opposite those at 68 are common side angles. The recess at J is receptive to a foundation bolt, and correctly positions the layout tool relative the bolt.

Virtually every edge and slot edge of plate 16 has a specific measurement purpose. Referring now primarily to FIGS. 2, 3, and 8A–8Q, the use of the layout tool of the present device will be discussed. The letters A–Z of FIGS. 2 and 3 correspond to the letters A′–Z′ of FIGS. 8A–8Q.

In FIG. 8A an end view of a partition wall made with four 2×4's is shown. Referring to FIG. 2, it can be seen that the separation between the two upright 2×4's is exactly equal to the distance between edges A and M of plate 16. Similarly, the partition of FIG. 8B can be quickly laid out because the distance C′–K′ is equal to the distance between edges C and K of slots 32 and 34, respectively. Utilizing the same layout techniques, partition walls 8C, 8D, 8I, 8K, and 8M can be quickly laid out. Similarly, corner walls 8E, 8F, 8G, 8H, and 8J can be laid out.

Referring now to FIG. 8N, it can be seen how quickly two side-by-side 2×4's can be laid out. By using edge "X" of aperture 50, the center of the 2×4's width can be quickly marked at 72, and by outlining the tool along edges A and M of the layout tool the marks A′ and M′ can be formed to show where the connecting studs between the two 2×4's should be placed. Similarly, in FIG. 8P, two 2×4's are shown stacked vertically such that marks X′, A′, and M′ can be drawn. Thus, the use of layout tool 12 has eliminated the need for many individual measurements with a standard square, tape, or ruler.

Referring to FIG. 8Q, layout tool 12 can be used to measure angles by engaging a corner 72 of the tool with the edge of a 2×4 and by aligning the angled markings on the surface of the tool to the appropriate angle. As mentioned earlier, markings are provided for angled cuts, hip and valley rafters, common rafters, and reversed side angles.

Referring now to FIG. 4 and 5, square adaptor 14 includes an attachment plate 74, and a pivotable ruber assembly 76. Attachment plate 74 includes a flat, square portion 78 and an upwardly and downwardly extending endpiece 80. The attachment plate is provided with slots 82 and ruler markings 84 along one edge.

Ruler assembly 76 includes an elongated arm 84 and a ruler 86 attached to the arm 84 by pivot pins 88. An endpiece 90 is removably attached to arm 84 by screws 92 so that ruler 86 can be attached to and removed from the arm 84. As seen in FIG. 5, ruler 86 can pivot up and down so as to accommodate any surface irregularities in the work piece. As seen in FIG. 6, square adator 14 can be attached to layout tool 12 such that ruler 86 is perpendicular to the longitudinal edges 60 and 64 of layout tool 12, or, as shown in FIG. 7, substantially a parallel extension of longitudinal edge 60. Either way, fasteners 92 are used to couple attachment plate 74 to square plate 16 of the layout tool to permit a limited degree of adjustment as suggessted by the broken lines in FIGS. 6 and 7. Thus, the present combination tool can be used as a square and/or as an extended ruler.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A construction layout tool comprising:

(a) an elongated, rectangular plate having two opposing logitudinal edges, two opposing transverse edges, and two opposing planar surfaces, said rectangular plate having first indicia marking a centerline located equidistant between said longitudinal edges, and provided with a central slot through said plate and aligned with said first indicia; and (b) a rectangular endpiece attached to a first transverse edge of said plate, said endpiece and said plate being substantially at right angles to each other, where a first portion of said endpiece extends away from a first planar surface of said plate for approximately twice the thickness of a standard 2×4, and where a second portion of said endpiece extends away from a second planar surface of said plate for approximately the thickness of a standard 2×4; wherein said first portion of said endpiece is provided with a central aperture having an edge located half way between said first planar surface and the edge of said first portion most distal from said first planar surface.

2. A construction layout tool as recited in claim 1 wherein the transverse width of both said plate and said endpiece is the transverse width of a standard 2×4.

3. A construction layout tool as recited in claim 1 wherein said endpiece is provided with second indicia marking a centerline that is half way across its transverse width.

4. A construction layout tool as recited in claim 3 wherein said first portion of said endpiece is further provided with a first lateral slot and a second lateral slot, said first lateral slot and said second lateral slot being symmetrically aligned on either side of said centerline.

5. A construction layout tool as recited in claim 1 wherein said rectangular plate is further provided with a semi-circular notch along a second transverse edge of said plate.

6. A construction layout tool as recited in claim 1 wherein said rectangular plate is further provided with a pair of side slots symetrically located on either side of said central slot.

7. A construction layout tool as recited in claim 1 wherein said rectangular plate is further provided with a triangularly shaped aperture located proximate a second transverse edge of said plate and aligned with said centerline.

8. A construction layout tool as recited in claim 1 further provided with a tape measure slot provided proximate said first transverse edge of said plate and aligned with said centerline.

9. A construction layout tool as recited in claim 1 wherein said said central slot is has a pair of edges which are parallel to each other and to said two opposing longitudinal edges of said plate.

10. A construction layout tool as recited in claim 1 wherein an end of said central slot proximate a second transverse edge of said plate is widened into a substantially square shaped head portion.

11. A construction layout tool as recited in claim 1 wherein an end of said central slot proximate said second transverse edge of said plate is widened into a notched, substantially square shaped tail portion.

12. A combination layout tool and square comprising:
a layout tool including
an elongated, rectangular plate having two opposing longitudinal edges, two opposing transverse edges, and two opposing planar surfaces; and
a rectangular endpiece attached to a first transverse edge of said plate, said endpiece and said plate being substantially at right angles, where a first portion of said endpiece extends away from a first planar surface of said plate and a second portion of said endpiece extends away from a second planar surface of said plate; and
a square adaptor including an attachment plate adapted to abut at least one of said two planar surfaces of said layout tool; and ruler means extending from an edge of said attachment plate.

13. A combination layout tool and square as recited in claim 13 wherein said attachment plate is T shaped having a flat portion adapted to abut at least one of said two planar surfaces and a pair of extensions along one edge for engaging an edge of said plate, said rule means extending from said edge having said pair of extensions.

14. A combination layout tool and square as recited in claim 13 wherein said ruler means includes an elongated support member and a ruler pivotally attached to said support member.

15. A combination layout tool and square as recited in claim 14 wherein said attachment plate is provided with at least one elongated slot, and at least one fastener engaging said slot and said rectangular plate of said layout tool, whereby said square adaptor may slide along said rectangular plate of said layout tool.

16. A construction layout tool comprising:
(a) an elongated, rectangular plate having two opposing longitudinal edges, two opposing transverse edges, and two opposing planar surfaces, the transverse width of said plate being substantially the transverse width of a standard 2×4, said plate being provided with centerline markings along a centerline approximately one half the way across said transverse width, an elongated, central slot aligned with said centerline, and an elongated first side slot and an elongated second side slot, said first side slot and said second side slog being symmetrically aligned on either side of said centerline; and
(b) a rectangular endpiece attached to a first transverse edge of said plate, said endpiece and said plate being substantially normal, the transverse width of said rectangular endpiece being substantially the transverse width of a standard 2×4, said endpiece being provided with centerline markings along a centerline approximately one half the way across said transverse width, and where a first portion of said endpiece extends away from a first planar surface of said plate and a second portion of said endpiece extends away from a second planar surface of said plate, the length of said second portion being substantially the thickness of a standard 2×4 and the length of said first portion being substantially twice the length of said second portion.

17. A construction layout tool as recited in claim 16 wherein an end of said central slot is widened into a substantially rectangular head.

18. A construction layout tool as recited in claim 16 wherein the other end of said central slot is widened into a tail having two sides parallel to said two opposing transverse edges.

19. A construction layout tool as recited in claim 16 wherein said plate is further provided with a triangular opening having an apex aligned with said centerline.

* * * * *